United States Patent [19]

Jelling et al.

[11] 3,990,625

[45] Nov. 9, 1976

[54] SPECIAL BAGS FOR BAGGING APPARATUS

[76] Inventors: Murray Jelling, 21 Spring Hill Road, Roslyn Heights, N.Y. 11577; Alexander Kahn, 30 E. Bayview Ave., Massapequa, N.Y. 11758; Ernest George Moore, 1630 Paula Lane, East Meadow, N.Y. 11554; Michael Friedman, 1178 E. 23rd St., Brooklyn, N.Y. 11210

[22] Filed: Aug. 8, 1975

[21] Appl. No.: 603,050

Related U.S. Application Data

[62] Division of Ser. No. 530,201, Dec. 9, 1974, Pat. No. 3,961,460.

[52] U.S. Cl. ..... 229/53; 206/390; 225/12; 225/106; 242/57; 271/258

[51] Int. Cl.[2] ..... B65D 33/00; B65D 85/67; B65H 35/10

[58] Field of Search ..... 242/57; 271/232, 258; 225/10, 12, 13, 106; 206/390; 229/69, 53

[56] References Cited

UNITED STATES PATENTS

| | | | |
|---|---|---|---|
| 2,648,183 | 8/1953 | Dalton | 53/389 |
| 2,693,988 | 11/1954 | Switzer | 225/12 X |
| 3,181,773 | 5/1965 | Jelling et al. | 206/390 |
| 3,308,601 | 3/1967 | Masters | 53/256 |
| 3,492,775 | 2/1970 | Rhine et al. | 53/29 |
| 3,589,095 | 6/1971 | James et al. | 53/51 |
| 3,865,235 | 2/1975 | Levy et al. | 206/390 X |

FOREIGN PATENTS OR APPLICATIONS

| | | | |
|---|---|---|---|
| 643,350 | 9/1950 | United Kingdom | 206/390 |

*Primary Examiner*—Stephen P. Garbe
*Attorney, Agent, or Firm*—Roberts & Cohen

[57] ABSTRACT

For a bagging device, there is provided a roll of polyethylene bags which are fed through a braking device and thence past spreading devices and a floating hook support, whereupon are engaged sequentially the hooks of hangers upon which garments or the like are supported. The bags are provided with indicia thereupon which can be detected by a detecting device to actuate the braking device so that the bags may be readily torn off before they seat on the respective garments being packaged.

11 Claims, 11 Drawing Figures

FIG. 2
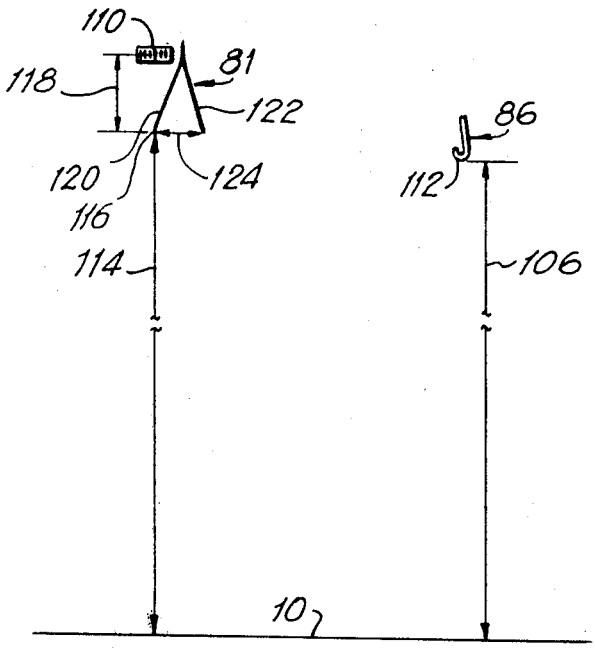
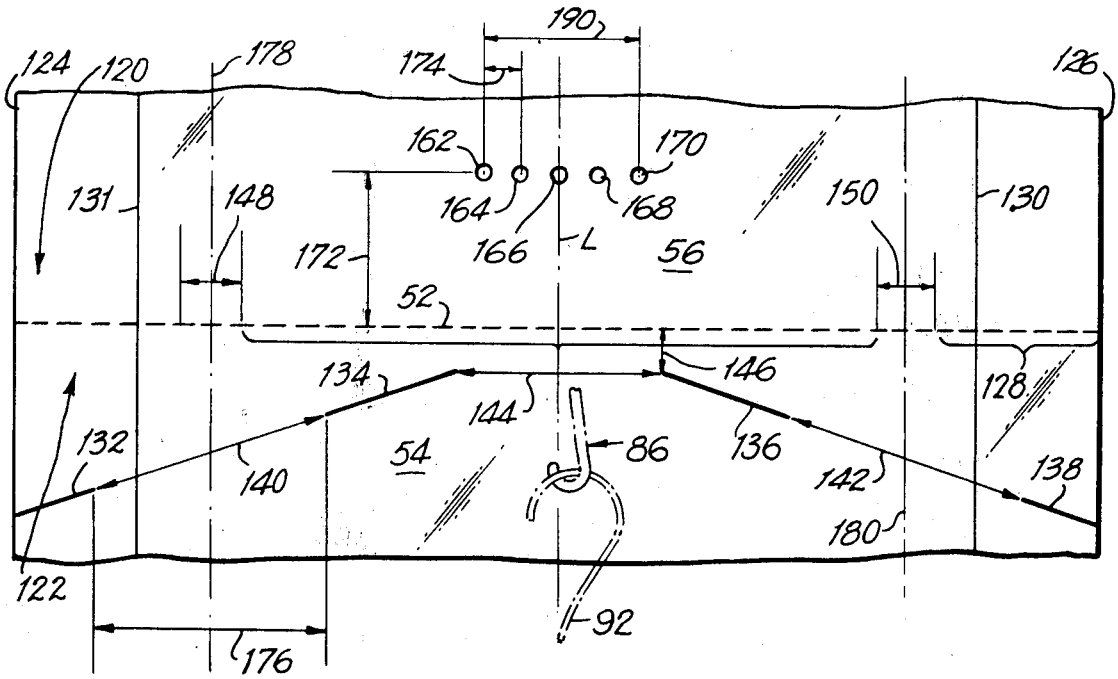
FIG. 3

FIG. 8
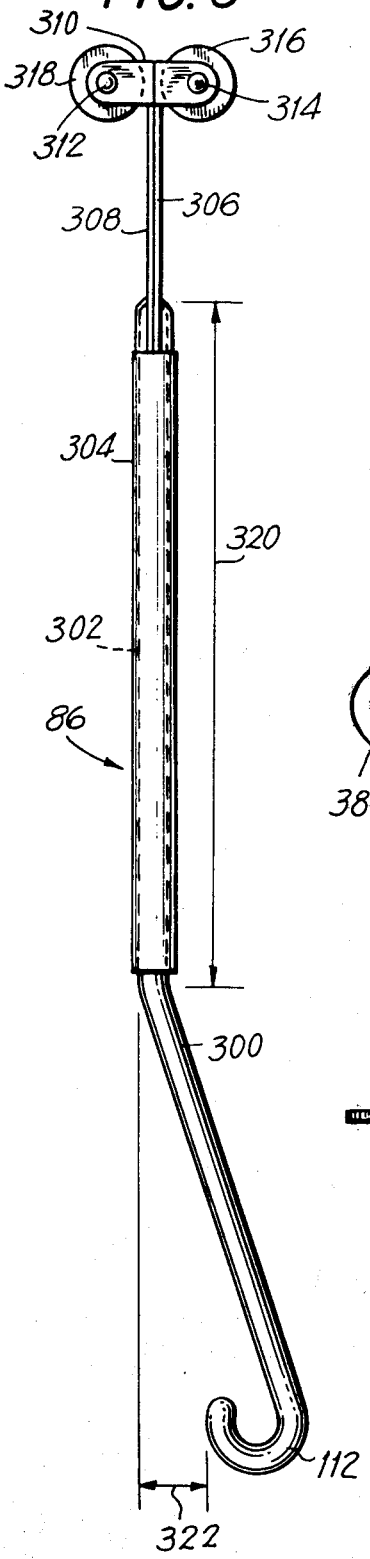
FIG. 9
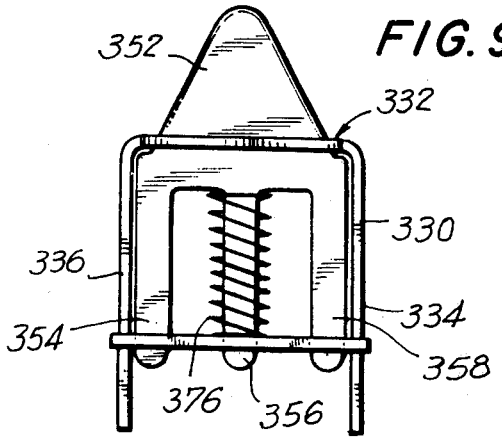
FIG. 11
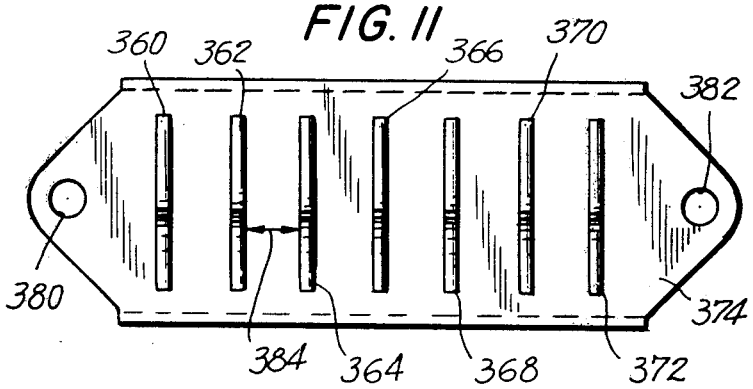
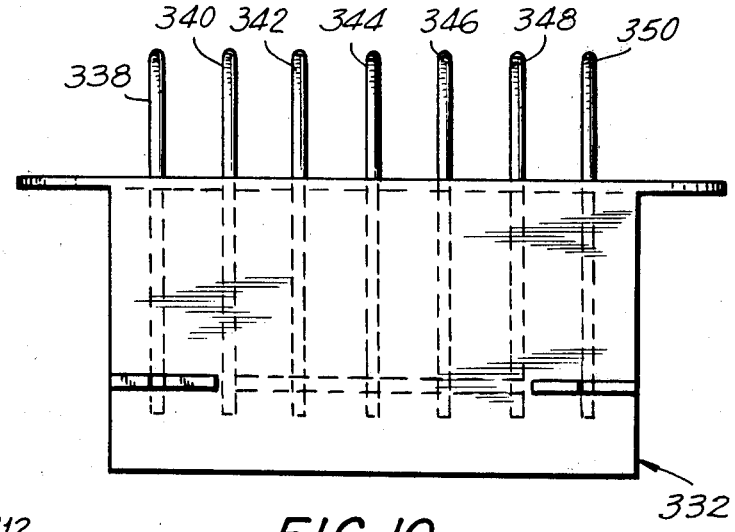
FIG. 10

SPECIAL BAGS FOR BAGGING APPARATUS

OTHER APPLICATIONS

This application is a divisional based on our earlier filed application Ser. No. 530,201 filed Dec. 9, 1974 now U.S. Pat. No. 3,961,460.

FIELD OF INVENTION

This invention relates to bags arranged in a continuous series and constituted, for example, by rolls of flatted tubing which is perforated and provided with seams to define a succession of detachable bags having closed or substantially closed ends. The invention also relates to bags and other such types of coverings as may be employed to protect garments or various other types of articles.

BACKGROUND

The protection of garments and other such articles with transparent plastic bags is a widely employed technique. These bags are most conveniently supplied in roll form in a continuous series from which the individual bags can be successively detached for use. One particular method which has proved successful is that according to which a garment is suspended in vertical disposition and the foremost bag of a series is drawn down over the same and detached.

For reasons of economy as well as ease of storage and utilization, bags of the above noted type are generally fabricated of a pliable plastic such as polyethylene to provide that such bags adapt readily to the shapes of the articles to be covered. Also, for reasons of economy and minimizing of weight, these bags are generally fabricated with a minimum wall thickness.

The use of a very small wall thickness and a pliable plastic enables bags of the aforesaid type to be provided in the form of a flatted tube, possibly having one or more longitudinal seams along which the tube is closed. This tube is provided with transverse alignments or lines of perforations constituting tear lines defining separate and detachable bags. The tube is further provided with substantially transverse seams formed by heat sealing or like techniques whereby the individual bags are provided with closed or substantially closed ends.

According to U.S. Pat. No. 3,287,881 as well as U.S. Pat. No. 3,181,773 the walls of flatted tubes of the above noted type are in close proximity to each other. While this is desirable for purposes of storage, packing and guidance and for various other reasons, the proximity of the opposed walls has a distinct disadvantage which can be avoided by the use of special provisions in the bagging techniques as well as in the bagging equipment and in the bags themselves.

More particularly, according to this known art, one or more spreading elements may be passed through the closed ends of the bags into the mouths of the next successive bags which mouths are thereby opened. In further accordance with this prior art there is provided a series of plastic bags each of which has leading and trailing edges, the leading edge being openable and the trailing edge being substantially closed. Mechanical spreading elements are arranged in substantially fixed positions adjacent a bagging station and the foremost of the aforementioned bags is drawn over the spreading element or elements onto this article. The spreading element or elements serve to pass through the trailing edge of the foremost bag into the leading edge of the next sequential bag until the trailing edge bears against the article such that the spreading element opens the leading edge of the next sequential bag. The foremost bag is detached from the series and the thusly bagged article can be removed.

While there are many distinct advantages to the above noted technique, there are certain additional problems which are not dealt with, namely the need to apply certain manual forces to separate the leading bag in the series from the remaining bags which are still affixed to one another. Furthermore, the known apparatus does not deal with eliminating certain tedious manual jobs pertaining to lifting the bagged garments from the bagging station as well as arranging such garments at the bagging station.

Still further, there has appeared some loss of bags due to tearing which in turn is due to the need for manually separating the leading bag from the remaining bags in the series without any mechanical or other type of assistance.

Still further, the known arrangements do not deal with the problem of minimizing the time to open sequential bags as they are brought to the bagging station. These various problems have been dealt with by the apparatus and techniques disclosed in copending application Ser. No. 530,201.

SUMMARY OF INVENTION

It is an object of the invention to provide improved bags and bag supplies for an improved bagging system and technique.

It is another object of the invention to provide an improved bag supply for the purpose of providing for the semi-automatic detachment of the leading bag in a series.

In achieving the above and other objects of the invention, there is provided a bagging apparatus comprising a source of flatted tubing, said tubing having spaced transversed lines of openings therein to define a sequence of detachable sections adapted for constituting bags for the bagging of baggable items. The tubing is adapted for being drawn from said source over the items at a bagging zone into which the items are sequentially moved. This enables the sequential bagging of the aforesaid items. The sections have detectable indicia and are provided with transverse seams at least in part closing the respective sections to form bags and limiting the penetration of said items into the bags at said bagging zone. Braking means are provided in accordance with copending application Serial No. 530,201 for braking the drawing of the tubing from said source. Detecting means are further provided which are sensitive to said indicia for operating the braking means whereby to facilitate detaching said detachable sections. This detachment occurs semi-automatically as the leading bag of the series is being drawn over the item being bagged by virtue of the operation of the braking means.

In further accordance with said copending application, bag spreading means are employed around which the tube is passed in order to facilitate passing the bags over the aforesaid items. The transverse seams provided in the bags have openings through which the bag spreading means may pass.

In further accordance with the invention, the aforesaid indicia are so related to the lines of openings that the braking means is operated by said detecting means to facilitate the detaching of one of said sections when the spreading means has entered the next sequential bag in the series.

According to a further feature of the invention, the indicia are so related to the lines of openings that the braking means are preferably operated when the spreading means is at least substantially completely within the next sequential bag.

Preferably the aforementioned source is spaced from the bagging zone and the braking means is between the source and bagging zone and closer to the latter.

In a preferred technique hangers are employed for supporting the items in the bagging zone, the hangers each including engageable hooks. The apparatus is further provided with hook engaging means for engaging these hooks and the tubing and hook engaging means are so related that the tubing is adapted to pass around the hook engaging means for sequentially drawing bags over items brought to the bagging zone and arranged on the aforesaid hangers. The transverse seams are in this event provided with openings through which the hook engaging means can pass.

According to still a further feature of the invention, the indicia are so related to the transverse seams of the next preceding bags in the sequence that the braking means are operated not later than the time at which the transverse seams of one said bag abuts an item on a corresponding one of said hangers.

According to still another feature of the invention, the aforesaid indicia are openings through the flatted tubing and said detecting means includes electric circuit means for operating the braking means, said circuit means including feeler means opened by said tubing and closable through said indicia openings.

According to still a further feature of the invention the indicia openings are located transversely of the tubing to be aligned with at least one of the openings in the transverse seams through which passes the hook engaging member or bag spreading means.

As still a further advantageous feature of the invention, the detecting means adapted for being includes means sensitive to the indicia openings but insensitive to the openings in the lines of openings defining the detachable bag.

According to the invention, each of the bags may have a plurality of indicia aligned in regularly spaced positions transversely of the associated bag, said detecting means including a plurality of regularly spaced feelers arranged to be at least substantially parallel to said plurality, the spacing between the feelers being different from the spacing between the said indicia whereby to avoid the consequences of relative parallel displacement between the indicia and the feelers.

In accordance with the invention, there is provided an article of manufacture for use with a bagging device which includes a braking device and a braking device controller. Said article of manufacture comprises a length of flatted tubing adapted to pass through said braking device controller and provided with transverse lines of openings dividing said length into a plurality of detachable sections adapted for constituting detachable bags, said tubing having indicia adapted for being detected by said controller to cause the controller to operate said braking device.

The aforesaid tubing may have a plurality of indicia in each bag arranged transversely of the tubing. Said indicia may be discrete indicia aligned in a row at least substantially parallel to said lines of openings.

The aforesaid tubing will have flat parallel sides or faces in face-to-face relation and said indicia may be openings extending through both said sides.

To form detachable bags, the sections may each be provided with a transverse seam adjacent one of the lines of openings associated therewith, each said seam being provided with a central opening adapted to accommodate the passage of a hanger hook and at least one further opening adapted for the passage of a bag spreader.

The indicia may be transversely aligned with the central or further openings. The indicia openings may be at least twice as large as the openings in said lines and preferably even substantially larger so that there is no confusion between the lines of openings intended for separating the bags and the indicia openings.

The seams should be no closer than about one-sixteenth of an inch to the closest line of openings and the lines of openings may be characterized by resistance to tearing which is less at the edges thereof than at the center thereof.

The indicia in each bag are closest to the line of openings in such bag to which the seam in the next adjacent bag is closest, the indicia being spaced from such line of openings about four to ten inches.

The indicia openings in each bag are preferably regularly spaced circular openings of about five-sixteenths of an inch diameter and the circular openings preferably have a center-to-center spacing of about three-quarters of an inch.

The rows of indicia openings are smaller than the central openings in the seams and are aligned with the central openings in a preferred arrangement. The central openings are moreover preferably in a range of about four inches in width. The abovementioned further openings are preferably in the range of about four and one-half inches in width.

Advantageously the braking device is adapted to exert a braking force on the tubing with the lines of openings being adapted to tear at said magnitude of force.

The above objects, features and advantages of the invention will be found in greater detail in the following description as illustrated in the accompanying drawing.

BRIEF DESCRIPTION OF DRAWING

In the drawing illustrating a preferred embodiment of the invention:

FIG. 2 is a diagramatic illustration of some preferred relationships of the different elements of the above noted apparatus with other critical relationships being indicated in other of the figures;

FIG. 3 illustrates a portion of a flatted tubing including the connected extremities of two connected bags of polyethylene or the like, other critical relationships being indicated in this figure;

FIG. 8 is a side view of a floating hook support employed in the apparatus of FIG. 1;

FIG. 9 is a side view of the detecting, feeling or sensing element employed in the apparatus of FIG. 1;

FIG. 10 is a top plan view of the apparatus illustrated in FIG. 9; and

FIG. 11 is a front view of the apparatus illustrated in FIG. 9.

DETAILED DESCRIPTION

Figure 1:
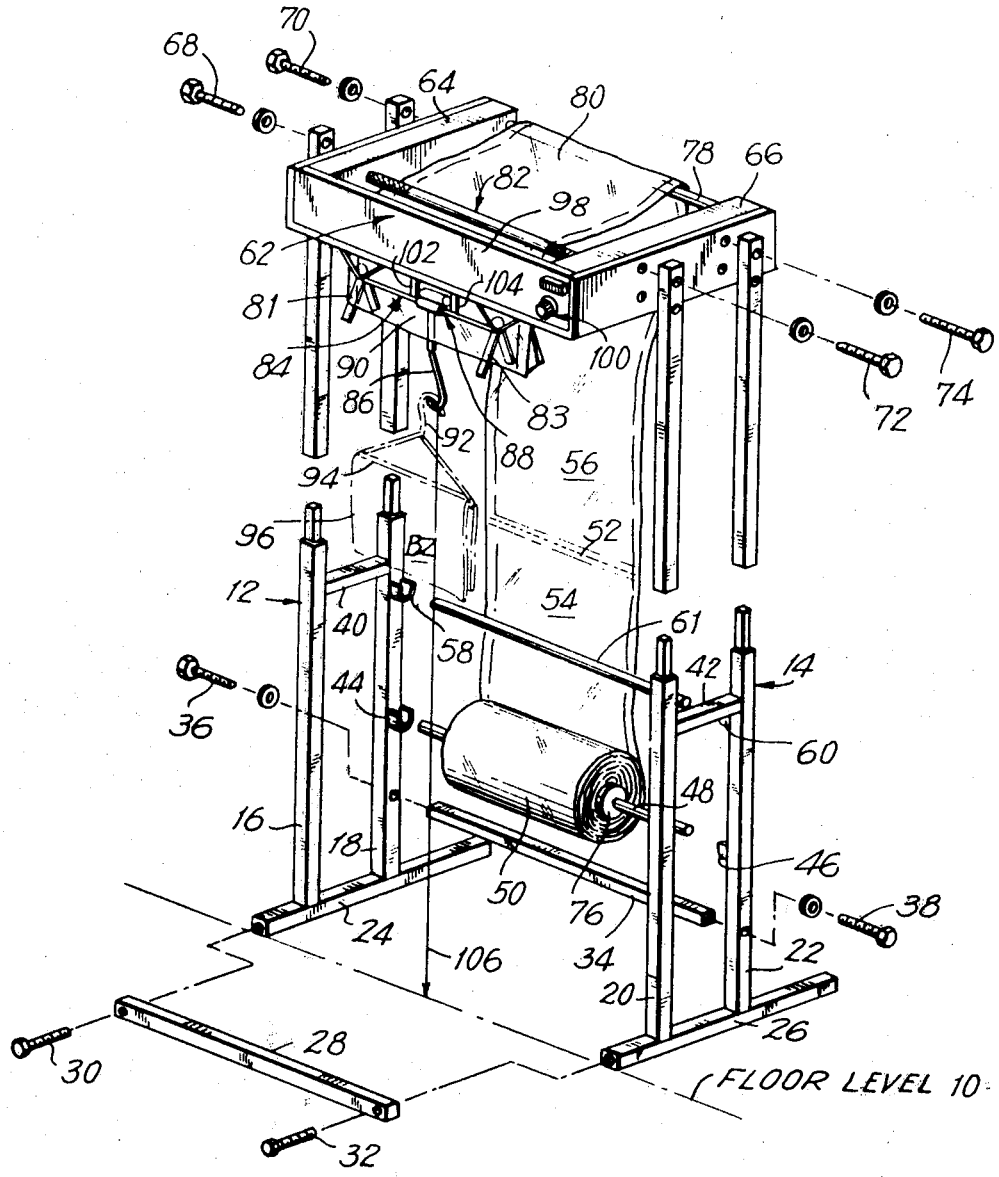
FIG. 1 is an exploded perspective view of a bagging apparatus of the invention, including a hanger hook arrangement, a spreader arrangement, a braking arrangement and a source of flatted tubing.

The apparatus of FIG. 1 is intended for the sequential bagging of items such as articles of clothing supported on respective hangers having engageable hooks and being of conventional shape and dimension.

More particularly, in FIG. 1 is shown a bagging apparatus intended to be supported on a floor, the level of which is generally indicated by line 10.

A horizontal strut 34 is connected intermediate posts 18 and 22 by means of bolts 36 and 38 and posts 16 and 18 are connected by means of an intermediate strut 40, whereas posts 20 and 22 are connected by means of an intermediate strut 42.

On struts 13 and 22 are respectively accommodated upwardly open receptacles 44 and 46 which accommodate a rod 48 on which is accommodated a source 50 of plastic bags constituted as will be described hereinafter by a plurality of plastic sections connected together at lines of openings or perforations indicated at 52 to form a length of flatted tubing having for example a sequence of sections or bags indicated generally at 54 and 56 by way of example.

Posts 18 and 22 may be connected with one or more additional pairs of upwardly opening receptacles such as, for example, indicated at 58 and 60 for purposes of accommodating the rod of the source of bags, such further rod being indicated by way of example at 61.

At the top of the posts 16, 18, 20 and 22 is the upper portion 62 of the apparatus. This upper portion includes a left side 64 and a right side 66, both of which include parts of the braking section of the apparatus as well as the detecting portion of the apparatus as will hereinafter be described in greater detail. The upper portion 62 is connected to the vertical post by means of bolts 63, 70, 72 and 74. It will, of course, be appreciated that other forms of connection can be used for the upper portion as well as for the other structural components as have been described hereinabove.

Referring again to the source 50 of polyethylene flatted tubing, it will be noted firstly that the source 50 is held centered on the rod 48 by means of centering discs arranged at opposite ends of the roll and of which is visible in FIG. 1 only the disc 76. A similar disc is located at the opposite extremity of the roll 50, these discs firmly engaging rod 48 and therefore holding the source or roll 50 firmly centered so that lateral shifting is generally avoided.

It will also be noted that the flatted tubing passes generally vertically upwards from the roll 50 and then passes around a rod 78 located rearwardly in the upper portion 62. Thereafter the flatted tubing passes as indicated at 80 into a horizontal plane whereafter it passes between a pair of braking members indicated generally at 82.

Suspended below and from the upper portion 62 is a framework arrangement indicated generally at 84. From this framework arrangement are suspended spreading elements 81 and 83 which will be described in greater detail hereinafter along with their relationship to the flatted tubing and the framework arrangement 84. The general function of the spreading elements 81 and 83 is to enter into the mouth of the leading bag in the sequence of bags or sections constituting the length of flatted tubing proceeding from the roll 50. This enables an operator to pass the leading bag easily and without substantial prior preparation over a garment arranged on a hanger suspended from a floating hook 86 which is floatingly supported as indicated generally at 88.

Referring again to the length of flat tubing which moves into horizontal disposition or attitude as indicated at 80, it will be noted that the flatted tubing takes a descending vertical attitude as indicated at 90 after having first been engaged by the braking section indicated generally at 82. As will be shown the flatted tubing proceeds downwardly between two halves or the sections of the framework arrangement 84 passing between the framework arrangement and the spreaders 81 and 83, on the one hand, and between the framework 84 and the support of the floating hook 86 on the other hand.

With respect to floating hook 86 and its support 88 it will be noted that the framework arrangement 84 supports a pair of rollers upon which one or more rollers attached to the floating hook 86 is supported. It will be furthermore noted that the hook 86 has a lower effective hooking extremity intended for engaging the hook 92 of a hanger 94 which is of conventional form and shape and upon which may be supported a garment 96 or the like which has been brought on the hanger to the bagging zone BZ adjacent the floating hook 86 and at which the foremost bag in the series is intended to be draped over the garment 96 for purposes of bagging the latter in an otherwise conventional operation.

It will of course be appreciated that, although a bagging operation has been shown involving the use of a hanger, the invention is susceptible of being applied to other bagging operations involving items other than garments or the like and in which the item to be bagged need not be be supported on a hanger nor on an element having a hook engaged by a floating hook arrangement as a result of which it may be possible to dispense with the floating hook arrangement. In addition, it should be noted that the illustrated bagging device while preferably employing the floating hook arrangement is also susceptible of being employed in connection with a floor supported post upon which is arranged a hook engaging element for supporting a garment arranged on a hanger having an engageable hook.

Referring again to the upper portion 62, it will be noted that there is arranged thereupon and at the decorative front 98 thereof a control generally indicated at 100. This control 100 will be described in greater detail hereinunder, but at the outset, it is sufficient to note that the control 100 provides for turning a source of electrical power on or off for purposes of operating the feeler, sensing or detector section of the apparatus of the invention and, furthermore, for controlling the length of the braking operation since, once braking operation is initiated in accordance with the invention, it runs for a limited period of time and is then automatically released. The specifics of this arrangement are given in copending application Ser. No. 530,201.

Finally with respect to FIG. 1, it should be noted that on the framework 44 are connected supporting elements 102 and 104 as will be shown hereinafter. These supporting elements which are only diagrammatically illustrated in FIG. 1 are intended to support a portion of the detecting arrangement as is described in greater detail in said copending application.

FIG. 1 furthermore indicates a dimension 106 this dimension running between the lower effective extremity of the floating hook 86 and floor level 10. Where the floating hook arrangement is employed, the dimension 106 has a preferred magnitude to provide for most convenient use of the apparatus by an operator who will be manually transferring hanger supported garments to the bagging zone from a rack. The magnitude of dimension 106 can be varied when provision is made for automatic transfer of garments to the bagging zone BZ for the use of mechanical linkages and conveyors.

Some important structural relationships and sizes and spacings are further indicated in diagrammatic form in FIG. 2 wherein is illustrated, by way of example, spreader element 81, feeler 110, floating hook 86 and floor level 10. Herein it will be seen that the dimension 106 referred to hereinabove with reference to FIG. 1 as extending between the floor level 10 and the lower extremity 112 of the hook 86 is preferably in the range of five to six feet. This accounts for the normal size of an operator who will be transferring bags from a rack or the like to the hook 86 and takes into account the type of operation which the operator will have to perform, and the dimension 106 which will most likely facilitate the transfer operation and minimize the fatigue. It will, of course, be appreciated that the vertical posts 16, 18, 20 and 22 of the bagging apparatus can be made telescopic and extensible in constructional detail so as to provide for an adjustment of dimension 106.

Referring next to the dimensions 114, this dimension runs between the floor level 10 and the lower most extremities of the spreader element 81 as indicated generally at 116. This dimension generally runs three to six inches greater than the dimension 106 and thus, for example, comprises a range of about five feet three inches to six foot six inches. The reason for this and the subsequent dimensions to be mentioned hereinbelow will be later discussed. However, it is first of interest to note that the distance from the active part of the feeler arrangement 110 to the lower extremity 116 of the spreader element 81 runs in a range of four to ten inches and is preferably about six inches, the overall dimension being indicated at 118. This dimension corresponds to the overall height of the spreader element 81 comprised between the beginning of the flare of the legs 120 and 122 of the spreader element, this flare proceeding to a girth of about three to six inches to provide for a spreading of the flatted tubing.

The reason for the spread girth of the legs 120 and 122 of spreader element 81, this girth being indicated at 124, is that a minimum size of about three inches is the size beneath which it is impossible for the operator to insert with ease one or both of his hands. At the same time, a spread of more than six inches may increase the bag tension which results when the operator is pulling the leading bag in the sequence down into bagging position, as will be discussed in greater detail hereinafter. The reason for the relative spacing between the feeler and the bottom of spreader 81 as well as the bottom of hook 86 is to provide that the brake should be actuated and the leading bag in the sequence torn off when the mouth of the next sequential bag in the sequence is at the bottom ends of the spreaders (plus or minus one inch and preferably about one inch below the end of the spreader) in order that the second said bag be in spread condition and readily engageable by the hands of the operator for being pulled down into the bagging zone for a bagging operation. In any event, it is preferred that the tearing operation should not be effected before the next sequential line of openings or perforations 52 has passed down onto the spreaders which might lead to a malfunctioning of the apparatus.

Reference is next made to FIG. 3 in which are shown the connected extremities of bags or sections 54 or 56. In review, it has been indicated above that the illustrated bagging apparatus employs a bag supply in the form of a continuous series of bags defined or formed in a pliable flatted tubing. The flatted tubing may be fabricated, for example, of pliable polyethylene and has a normal thickness of several ten thousandths of an inch. The flatted tubing has face-to-face sides or faces arranged in substantially parallel proximate relationship. The tubing is provided with a plurality of generally equidistantly spaced alignments or transverse lines of perforations such as indicated at 52 which constitute tear lines and divide the tubing into a sequence of separable sections of bags having, for example, leading edges or mouth sections 120 and trailing sections 122. The longitudinal axis of the tubing is indicated at L and the tubing has spaced lateral edges indicated at 124 and 126. The lines 52 are preferably although not necessarily arranged perpendicularly with respect to the longitudinal axis L and also with respect to the lateral extremities or edges 124 and 126. The method of forming the lines of perforations is known to those skilled in the art and requires no further explanation in this text. However, it will be noted that the line 52 may be preferably provided with two lateral sections, one of which is indicated at 128, which are weaker than the connecting central section for purposes of facilitating the lateral tearing of the bags. This section 128 may, for example, approximate the depths of the gussets 130 and 131 which may be provided in conventional manner at the lateral edges 124 and 126.

Adjacent each said tear line 52 is a seam, the sections 132, 134, 136 and 138 of which appear in the FIG. 3. Sections 132 and 134 define an opening 140 whereas sections 136 and 138 define an opening 142. The purpose of openings 140 and 142 is to provide for passage through the seam of the two spreader elements 81 and 83 referred to hereinabove with respect to FIG. 1.

In addition to the above, it will be noted that the upper extremities of seam sections 134 and 136 are spaced apart by a distance indicated at 144. This opening is intended to permit the passage through the seam of the floating hook arrangement which has been referred to hereinabove.

It will be noted that the upper extremities of seam sections 134 and 136 are spaced from the tear line 52 by a distance indicated at 146. This distance is preferably within the range of one-sixteenth to one-half of an inch so that the seam does not intersect the tear line 52 and thus hold together the two faces or sides of the flatted tubing at the tear line whereupon it would not be possible to conveniently open the mouth 120 of the next sequential bag 56 since the seam would interfere with this operation. It should therefore be noted that the line of openings or perforations 52 is an open arrangement which does not attach the two faces of the flatted tubing, but is instead intended only for purposes of a tearing operation without providing connections between the said two faces.

The effective widths of the spreaders 81 and 83 are generally indicated at 148 and 150 and it will be seen that these effective widths are exceeded preferably by at least twice the magnitude thereof by the dimensions of openings 140 and 142. The floating hook is diagrammatically indicated at 86 with the engageable hook of an associated hanger being again indicated at 92.

A row of indicia 162, 164, 166, 168 and 170 are arranged in the leading portion 120 of the next sequential bag adjacent the tear line 52 for purposes of effecting and controlling a braking operation. The tear line 52 is one of two tear lines bounding the foremost section 54 and is the tear line of the section 54 to which the seam consisting of sections 132, 134, 136 and 138 is the closest. The distance of the center of row of indicia 162–170 from tear line 52 is indicated at 172 and is preferably about six inches and within the range 118 indicated hereinabove relative to FIG. 2. The row of indicia is preferably aligned within the opening 144 (i.e., both are generally aligned along the longitudinal axis L). and is less than the width of the latter so that no confusion is possible between the seam and the row of indicia. The reason for this is that the seam is sometimes made in the form of a series of seals formed by thermal perforations resulting from the sealing operation between the two opposite faces of the flatted tubing and the holes forming part of the seam may sometimes achieve a dimension which may result in some confusion with the indicia 162–170. As an alternative, it may sometimes be possible to transversely align the indicia 162–170 with the openings 140 and 142 for the same reason as given hereinabove relative to opening 144.

The openings 162–170 which constitute the indicia may preferably be circular in shape and may preferably have the dimension of about five-sixteenths of an inch. This dimension is sufficiently larger than the dimension of the openings or perforations forming the line 52 so that no confusion will result between the same. Thus the openings 162–170 are preferably at least twice as big as the openings in line 52 and are more preferably in the order of five or more times larger than the openings in line 52.

In the preferred embodiment, the indicia openings 162–170 have a center-to-center spacing as indicated at 174 of about three-quarters of an inch. Thus the row of openings has an overall dimension of about three and five-sixteenths inches whereas the opening 144 under corresponding circumstances will have a width of about four inches. At this time, it is appropriate to note that an illustrative transverse dimension of openings 140 and 142 as indicated at 176 may be, for example, four and one-half inches.

The spreader center lines are indicated at 178 and 180 and the sensor or detector center line is coincident with the longitudinal axis L. The center-to-center distance of the outermost indicia openings 162 and 170 is indicated at 190, this distance being in the order of magnitude of about three inches.

The distance from the center of the row of indicia to the line 52 is indicated at 172. This as has been generally indicated above is also the distance from the bottom of the feeler or effective position of the feeler to the bottom of the spreaders 81 and 83. The effective length of the floating hook must be longer so that the seal does not hit the shoulder of the garment or the hanger before the braking action so that, after tearing occurs, a slight additional movement is preferably available to bring the bag down around the shoulders of the garment situated on the hanger in the bagging zone. The tear line should be strong enough so as not to tear prematurely under the tensile force applied to the leading edge of the first bag in the sequence by the operator, but the tear line 52 should be weak enough to tear when the brake is applied as described hereinafter. As has also been indicated hereinabove, the operation may be facilitated by providing weaker lateral portions in the tear line 52 such as has been indicated at 128.

Figures 4, 5, 6, 7:
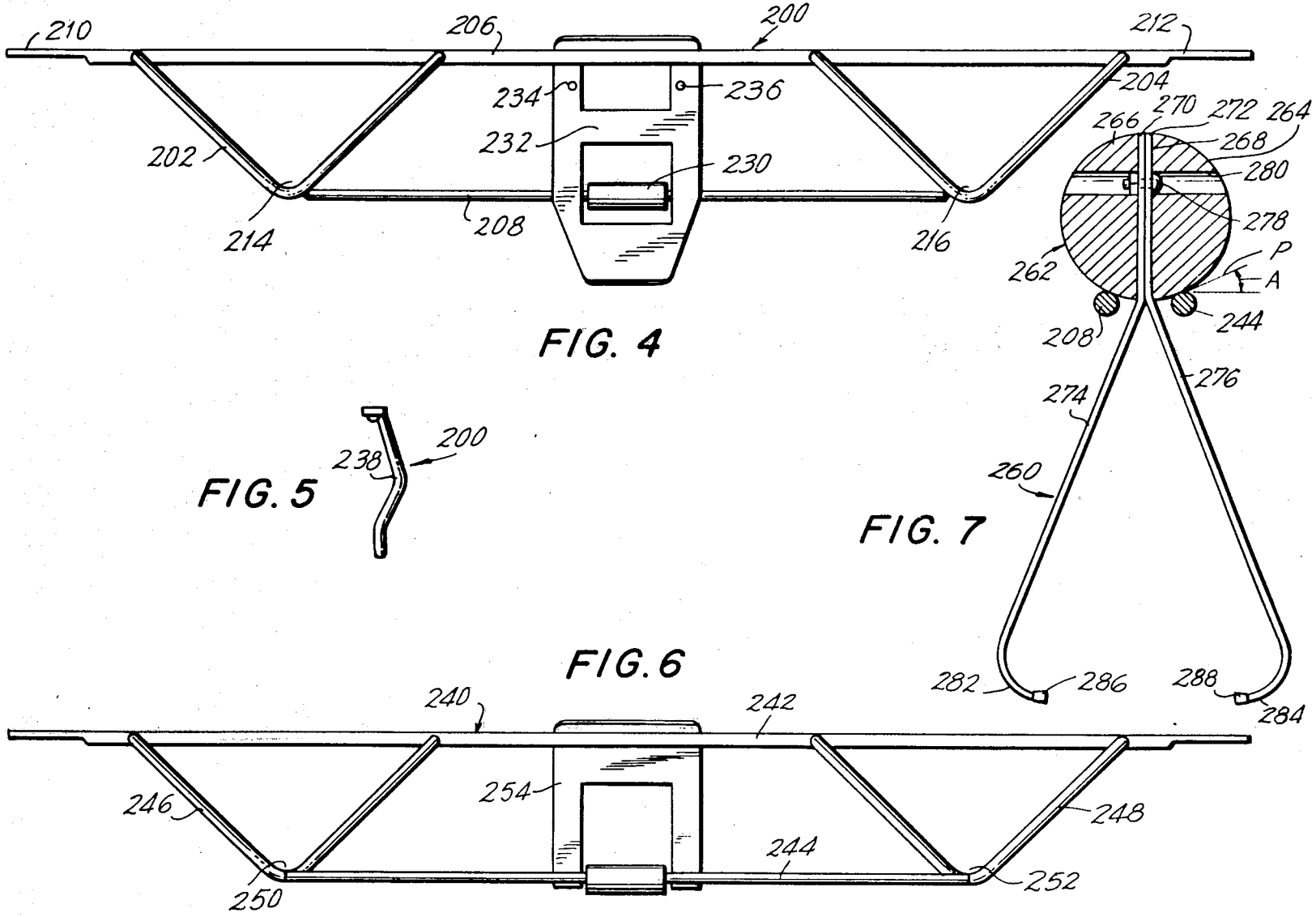
FIG. 4 is a front plan view of a frame section adapted for holding spreading and detecting elements as well as hook supports in the apparatus of FIG. 1.
FIG. 5 is a fragmentary end view of the structural feature illustrated in FIG. 4.
FIG. 6 is a plan view of a frame intended to be paired with the frame of FIG. 4 and supporting element cooperating with the feeling element structure in FIG. 4.
FIG. 7 is a side partially sectional view of a spreading element employed in the apparatus of FIG. 1.

FIGS. 4 and 5 illustrate a portion of the framework to which reference has been made above. In FIGS. 4 and 5 appears a frame indicated generally at 200 including two V-shaped sections 202 and 204 connected by an upper rod 206 and a lower rod 208, these rods being connected in parallel spaced relationship. The upper rod 206 has a thinned out extremity 210 and a corresponding opposite extremity 212 which are engaged in supporting elements (not shown) to hold the frame 200 in fixed position.

The V-shaped portions 202 and 204 have lowermost apices 214 and 216 and since the frame 200 faces a correspondingly shaped frame as will be indicated hereinafter, both the portions 202 and 204 as well as the rods 206 and 208 are held in spaced relationship to parallel corresponding elements whereby the apices 214 and 216 may entrap therewith portions of spreader elements 81 and 83 as will be described in greater detail hereinafter.

The lower rod 208 supports a roller 230 at least the surface of which is preferably made of Teflon. Thus there are a pair of such rollers and this pair of rollers is used to support one or more rollers forming a part of the floating hook arrangement as will be described in greater detail hereinafter.

Also supported on the frame 200 between rods 206 and 208 is a feeler or sensor support 232, the details of which will be described hereinbelow. The support 232 includes openings 234 and 236 by means of which the feeler or sensor is connected.

The frame 200 is provided with a recess 238, the recess 238 serving to match up with a corresponding recess in the opposed frame to form an opening through which the spreader elements may be loaded into the framework arrangement as will become apparent hereinafter.

FIG. 6 illustrates the corresponding or matching or opposed frame indicated generally at 240. This frame also contains space paralleled rods indicated at 242 and 244 connected by two V-shaped sections 246 and 248 having apices 250 and 252 serving to match up with apices 214 and 216 indicated hereinabove with respect to FIG. 4. Between rods 242 and 244 is a plate or strike 254, the purpose of which is to cooperate with the feeler arrangement mounted on the opposed frame, as will be indicated in greater detail hereinafter. It should be noted at this point, however that the frames 200 and 242 are preferably made of an electrically conducted material as is the strike 254 and the feeler to be described hereinafter so that an electrical circuit can be closed when the indicia noted hereinabove pass between the feeler and the strike 254 to initiate a braking operation as will be later described.

At this point, it should be noted that while the indicia of the invention have been generally indicated as being apertures or openings and, in fact, this is the preferred embodiment of the invention, it is also possible to use other types of indicia. Thus for example, there may be substituted for the above described openings opaque spots or the like which may be photoelectrically detected or metal pieces which may be electrocapacitively detected or, in fact, the size and shape of the aforementioned holes may be varied, or the indicia openings may be substituted for by a single elongated opening. Experience has indicated, however, that a plurality of openings constituting the indicia and arranged as mentioned hereinabove relative to FIG. 3 is to be preferred for long range continued operation of the apparatus with a minimum of operational and maintenance difficulties.

FIG. 7 generally indicates one form of spreading arrangement which may be employed although various other forms of spreader arrangement have also been indicated in prior Patent 3,287,881. However, although other spreader arrangements are possible, the type of arrangement illustrated in FIG. 7 is preferable and this arrangement is preferably fabricated of a material which has a weight which does not exceed approximately two to three ounces.

The spreader arrangement in FIG. 7 which, in fact shows the details of the spreaders 81 and 83 referred to hereinabove, consists of a flared portion 260 and a bulbous portion 262. The bulbous portion is of a material having a low coefficient of friction and is preferably fabricated, for example, of Teflon. It may be formed of two halves 264 and 266 having a slot 268 therebetween in which the upper extremities 270 and 272 of the flared portions 274 and 276 are accommodated. Alternatively, the sections 264 and 266 may be made of a single piece into which the extremities 270 and 272 are inserted.

The connection of sections 270 and 272 by means of a bolt 278 accommodated in an opening 280 is indicated. These sections may however be connected by welding or cementing or by any other technique desired. Additionally these sections need not be connected and may be loose relative to one another provided that longitudinal or vertical displacements therebetween is not possible.

The lower extremities or effective extremities of sections 274 and 276 are indicated at 282 and 284. These sections are circular in shape and are toed inwardly towards each other. The absolute inner extremities may be covered as indicated at 286 and 288 so that no engagement with the flatted tubing is possible which might operate to tear the latter. The length of sections 274 and 276 as well as the effective spacing of the lower extremities has been discussed hereinabove and need not be repeated at this time.

FIG. 8 is a more detailed view of the floating hook arrangement 86 and its lower hook engaging extremity 112. Therein it will be seen that the hook engaging extremity includes a portion 300 offset from the central portion 302 of the floating hook arrangement, section 302 being covered by a heat shrink tubing 304 preferably of a smooth plastic having a low coefficient of friction so as to minimize frictional engagement with the flatted tubing which passes thereover.

The portion 302 includes an extension in the form of two plates 306 and 308 at the end of which are supported two spaced brackets one of which is indicated at 310. These brackets support pins 312 and 314 upon which are supported two rollers 316 and 318 at least the surfaces of which are preferably made of a plastic having a low coefficient of friction such as Teflon.

The length of section 304 may be, for example, in the order of four and one-half inches and this dimension is illustrated in the drawing at 320. The displacement of hook engaging section 112 is indicated at 322 and may be, for example, in the order of one-half of an inch. The radius of the hook engaging section 112 may be for example in the order of three-eighths of an inch.

The aforesaid rollers 316 and 318 are supported by the pair of rollers supported by the framework arrangement described hereinabove and of which, for example, roller 230 is illustrated in FIG. 4.

The finish of the material from which the hook arrangement is made is preferably electropolished to minimize frictional engagement with the flatted tubing which passes therearound.

The feeler or sensing arrangement is illustrated in FIGS. 9–11 wherein appears a bracket 330 having a front portion 332, a bottom portion 334 and an upper portion 336. The arrangement consists of a plurality of feelers indicated at 338, 340, 342, 344, 346, 348 and 350.

The feelers 338-350 each include a triangular nose section indicated, for example at 352. Each feeler also includes a plurality of parallel spaced arms or legs indicated at 354, 356 and 358. The nose sections extend through slots 360, 362, 364, 366, 368, 370 and 372 provided in the front 374 of the arrangement. A spring 376 is engaged on at least one leg of each of the feelers to springload the feelers so that the noses 352 are projected outwardly from the arrangement in a resiliently displaceable manner.

The front 374 is moreover provided with openings 380 and 382. With reference to FIG. 4, it can be seen that these openings correspond to openings 234 and 236, the sensor arrangement being mounted on a plate 232 by bolts (not shown) passing through the corresponding openings.

From the above, it will be seen that the sensor arrangement of FIGS. 9–11 can be mounted so that the noses are directed in such a manner as to engage against the plate 254 illustrated in FIG. 6, the noses being springloaded as described above to permit the passage of flatted tubing therebetween. Therefore, when the noses selectively engage the indicia openings of the invention, they pass therethrough and engage against the plate 254 thereby providing the means for closing an electrical circuit to be described in greater detail hereinafter.

Before departing from a description of FIG. 9–11, it should be noted that the number of noses is different from the number of indicia openings. It will also be noted that the spacing between the feelers of the invention such as indicated at 384 is different from the spacing between the indicia openings. Thus the number and spacing of the feelers is different from the number and spacing of the indicia opening. The purpose of this is to provide that, should there be a slight transverse displacing of the flatted tubing and of the indicia thereupon as the flatted tubing moves through the apparatus of the invention, a detection of the indicia openings will nevertheless be assured by virtue of the different number of feelers and different spacing of the feelers relative to the corresponding dimensions and attitude of the indicia openings.

In the preferred technique of the invention, hangers are employed supporting the aforesaid items in said bagging zone, said hangers, including engageable hooks, said apparatus further comprising hook engaging means for engaging said hooks and around which said tubing passes for sequentially drawing bags over the items on said hangers, said transverse seams having openings through which the hook engaging means can pass.

The indicia are preferably so related to the transverse seams of the next preceding bags in the sequence that the braking means is operated not later than the time at which the transverse seam of one said bag abuts an item on a corresponding one of said hangers.

The indicia openings are located transversely of the tubing to be aligned with at least one of the openings in the transverse seams through which passes the hook engaging means or bag spreading means as has been described.

The detecting means includes means sensitive to the indicia openings, but insensitive to the openings in the lines of openings which are too small to be picked up by virtue of the dimension of the feeler elements.

Each of the bags may have a plurality of indicia aligned in regularly spaced positions transversely of the associated bag, said detecting means including a plurality of regularly spaced feelers arranged to be at least substantially parallel to said plurality of indicia, the spacing between the feelers being different from the spacing between the indicia whereby to avoid the consequences of relative parallel displacement between the indicia and feelers.

As has been noted, the invention provides an article of manufacture for use with a bagging device which includes a braking device and a braking device controller. Said article comprises a length of flatted tubing, preferably in the form of a roll, adapted to pass through said braking device controller and provided with transverse lines of openings dividing said length into a plurality of detachable sections adapted for constituting bags, said tubing having indicia adapted for being detected by said controller to cause the controller to operate said braking device. The tubing is provided with a plurality of indicia in each section arranged transversely of the tubing. The indicia may be discrete indicia aligned in a row at least substantially parallel to the aforesaid lines of openings. As noted above, the tubing has flat parallel sides in face-to-face relationship, said indicia being openings extending through both said sides.

Each said bag may be provided with a transverse seam or at least substantially transverse seam adjacent one of the lines of openings associated therewith, each seam being provided with a central opening adapted to accommodate the passage of a hanger hook and at least one further opening adapted for the passage of a bag spreader. Said indicia are transversely aligned with the central or further openings mentioned hereinabove.

The indicia openings are at least twice as large as the openings in said lines and the seams are preferably no closer than about one-sixteenth of an inch from the closest line of openings. The line of openings are characterized by resistance to tearing which may be less at the edges thereof than at the center thereof and this resistance to tearing is less than the braking force.

The indicia in each bag are closest to the lines of openings in such bag to which the seam in the next adjacent bag is closest, the indicia being spaced from such line of openings by about four to ten inches. Moreover the indicia openings in each bag are regularly spaced circular openings in the preferred embodiment and have a diameter of about five-sixteenths of an inch. The circular openings have a center-to-center spacing of about three-quarters of an inch and rows of indicia of openings are smaller than the central openings in the seams and are aligned therewith.

The rows of central openings may be in a range of about four inches in width and the further openings are somewhat larger than the same.

There will now be many modifications and variations of the articles of manufacture mentioned hereinabove. These modifications and variations will not depart from the scope of the invention if defined by the following claims.

We claim:

1. An article of manufacture for use with a bagging device which includes a spreader, a braking device and a braking device controller, said article comprising a length of flatted tubing adapted to pass around said spreader and through said braking device controller and provided with spaced transverse lines of openings dividing said length into a plurality of detachable sections, said tubing having indicia adapted for being detected by said controller to cause the controller to operate said braking device, and positioned for the detachment of the foremost section with said spreader at least in part within the next section, said tubing having flat parallel sides in face-to-face relation and said indicia being openings extending through both said sides, each said section being provided with a transverse seam adjacent one of the lines of openings associated therewith to form the associated section into a bag, each said seam being provided with a central opening adapted to accommodate the passage of a hanger hook, said indicia being aligned with the central opening.

2. An article of manufacture as claimed in claim 1 wherein the indicia openings are at least twice as large as the openings in said lines.

3. An article of manufacture as claimed in claim 2 wherein the lines of openings are characterized by resistance to tearing which is less at the edges thereof than at the center thereof.

4. An article of manufacture as claimed in claim 2 wherein the indicia in each bag are spaced from the nearest line of openings by about four to ten inches.

5. An article of manufacture as claimed in claim 1 wherein there are a plurality of indicia openings in each bag and wherein the indicia openings in each bag are regularly spaced circular openings of about five-sixteenths of an inch diameter.

6. An article of manufacture as claimed in claim 5 wherein the circular openings have a center-to-center spacing of about three-quarters of an inch.

7. An article of manufacture as claimed in claim 1 wherein there are rows of indicia in each section and wherein the rows of indicia openings are smaller than said central openings in said seams and are aligned with the central openings.

8. An article of manufacture as claimed in claim 7 wherein the central openings are in the range of 2–5 inches in width.

9. An article of manufacture as claimed in claim 1 wherein said each section is provided with a transverse seam adjacent one of the lines of openings associated therewith to form the associated section into a bag, each said seam being provided with a central opening adapted to accommodate the passage of a hanger hook, the central openings in the seams and said indicia being generally aligned along the longitudinal axis of said tubing.

10. An article of manufacture as claimed in claim 1 for use with a controller including an alignment of spaced sensers adapted to detect said indicia, each said section having a plurality of said indicia the number of indicia in each plurality of indicia being different from the number of sensers, the spacing of the indicia in each plurality being different from the spacing of the sensers.

11. An article of manufacture as claimed in claim 1 wherein the seam is provided with at least one additional opening adapted for the passage of a bag spreader.

* * * * *